US007048271B2

(12) United States Patent
Sheng et al.

(10) Patent No.: US 7,048,271 B2
(45) Date of Patent: May 23, 2006

(54) SHEET SEPARATOR FOR AN AUTOMATIC DOCUMENT FEEDER

(76) Inventors: Thomas Sheng, No. 20, Creation Rd. 1, Science-Based Industrial Park, Hsinchu (TW); Huan-Hsing Hsiao, No. 28-1, Nan Fu Tsun, Nan Chuang Hsiang, Miao Li County (TW)

( * ) Notice: Subject to any disclaimer, the term of this patent is extended or adjusted under 35 U.S.C. 154(b) by 100 days.

(21) Appl. No.: 10/681,124

(22) Filed: Oct. 9, 2003

(65) Prior Publication Data

US 2004/0251595 A1 Dec. 16, 2004

(30) Foreign Application Priority Data

May 9, 2003 (TW) ..... 92208526 U

(51) Int. Cl.
*B65H 3/52* (2006.01)

(52) U.S. Cl. ..... 271/121; 267/154; 267/155; 188/67; 271/124; 271/125

(58) Field of Classification Search ..... 271/121, 271/124, 125, 116, 122; 267/154, 155; 188/67
See application file for complete search history.

(56) References Cited

U.S. PATENT DOCUMENTS 4,208,046 A * 6/1980 Shimizu ..... 271/122
5,016,866 A * 5/1991 Takahashi ..... 271/122
5,158,279 A * 10/1992 Laffey et al. ..... 271/272
5,435,538 A * 7/1995 Billings et al. ..... 271/34
5,564,689 A * 10/1996 Fukube ..... 271/122
6,585,252 B1 * 7/2003 Russo et al. ..... 271/122

FOREIGN PATENT DOCUMENTS

JP 58-119526 * 7/1983
JP 62-275941 * 11/1987

* cited by examiner

*Primary Examiner*—Donald P. Walsh
*Assistant Examiner*—Thomas Morrison

(57) ABSTRACT

A sheet separator for an automatic document feeder of the invention is capable of separating an outmost sheet from a stack. The separator includes a separating roller driven by a driving device, a friction roller, a first shaft, and a force-applying mechanism for pushing the separating and friction rollers against each other. The friction roller has a first rotating state, in which the friction roller is driven by the separating roller, a stationary state when the separating roller feeds a first sheet, and a second rotating state, in which the friction roller is driven by a second sheet fed by the separating roller. The first shaft is inserted into the friction roller to provide a damping torque for stopping the rotation of the friction roller.

16 Claims, 8 Drawing Sheets

SHEET SEPARATOR FOR AN AUTOMATIC DOCUMENT FEEDER

This nonprovisional application claims priority under 35 U.S.C. § 119(a) on Patent Application No. 092208526 filed in TAIWAN on May 9, 2003, which is herein incorporated by reference.

BACKGROUND OF THE INVENTION

1. Field of the Invention

The invention relates to a sheet separator for an automatic document feeder, and more particularly to a sheet separator using two friction rollers to separate a sheet from a stack and then feed the sheet.

2. Description of the Related Art

An automatic document feeder may be used in an image input/output apparatus such as a scanner, a multi-function peripheral, a copier, or a printer. In order to feed the sheets one by one, the automatic document feeder must be equipped with a sheet separator so as to avoid error operations of feeding multiple sheets simultaneously.

FIG. 1 is a schematic side view showing a sheet separator for a conventional automatic document feeder. FIG. 2 is a schematic front view showing the sheet separator for the automatic document feeder (ADF) of FIG. 1. As shown in FIGS. 1 and 2, an ideal design of the conventional sheet separator is ideally configured to feed a plurality of sheets 120 one by one. The sheet separator includes a friction roller (also referred to as ADF roller). 110, and a friction pad 112 rotatable about a shaft 114. When the sheet 120 has not been fed, the friction pad 112 is always in contact with the stationary or rotating friction roller 110 and is thus worn out. When the outmost sheet 120 of FIG. 1 passes between the friction pad 112 and the friction roller 110, the sheet under the outmost sheet 120 may be stopped by the friction pad 112, and the sheet-separating operation may be achieved.

However, the sheet separator in the above-mentioned prior art has the following problems.

1. Since the friction pad 112 and the friction roller 110 are directly in sliding friction contact, the friction pad 112 and the friction roller 110 tend to be worn out, and the friction pad 112 that is somewhat worn out tends to cause errors in sheet-separating operations.

2. Since the friction pad 112 and the friction roller 110 are in sliding contact with each other, a motor has to provide a larger torque to drive the friction roller 110.

FIG. 3 is a schematic side view showing another sheet separator for a conventional automatic document feeder. FIGS. 4A and 4B are a pictorial view and a side view showing the friction roller of FIG. 3, respectively. As shown in FIGS. 3, 4A and 4B, the sheet separator includes a separating roller 200 and a friction roller 210. The separating roller 200 is driven to rotate by a second shaft 202, and drives the friction roller 210 to rotate using the friction force. When a sheet 230 enters the path between the two rollers, the friction roller 210 does not rotate to stop other sheets from entering the path. At this time, the sheet 230 can slide relative to the friction roller 210, but cannot slide relative to the separating roller 200. The above-mentioned phenomenon is caused by the special design for the friction roller 210. The friction roller 210 is composed of a hollow column 211, a spring 212, a friction plate 213, a fixing member 214 and two C-rings 215.

The two C-rings 215 are fastened to two ends of a first shaft 220 to provide a compression force to the spring 212 along an axial direction of the first shaft 220, and thus to provide a friction force to the friction surface 216 between the friction plate 213 and the fixing member 214, thereby stopping the rotation of the hollow column 211 fixed to the fixing member 214.

In the above-mentioned prior art, since the pushing mechanism constituted by a lot of parts between the two C-rings 215 is difficult to be manufactured and assembled, the manufacturing and assembling costs cannot be effectively reduced. In addition, the C-rings 215 have to additionally exert an axial compression force on the first shaft 220 of the friction roller 210, thereby complicating the design.

Consequently, it is an important subject of the invention to provide a sheet separator capable of overcoming the above-mentioned problems.

SUMMARY OF THE INVENTION

It is therefore an object of the invention to provide a sheet separator capable of separating an outmost sheet from a stack.

Another object of the invention is to provide a sheet separator capable of effectively reducing wear and saving a power output for an automatic document feeder equipped with the sheet separator.

In order to achieve the above objects, the invention provides a sheet separator for an automatic document feeder. The sheet separator includes a separating roller, a friction roller, a first shaft, and a force-applying mechanism. The sheet separator for the automatic document feeder is used to separately feed a first sheet and a second sheet adjacent to the first sheet. The separating roller is driven to rotate by a driving device. The friction roller has a first rotating state, in which the friction roller is driven by the separating roller, a second rotating state, in which the friction roller is driven by the second sheet, and a stationary state. In the stationary state of the friction roller, the separating roller directly feeds the first sheet, and the friction roller pushes the second sheet toward the first sheet such that the first sheet slides on the second sheet. The first shaft is inserted into the friction roller to provide a damping torque for stopping the rotation of the friction roller. The force-applying mechanism pushes the separating roller and the friction roller against each other.

According to the above-mentioned structure, it is possible to reduce the wear between the separating roller and the friction roller, and to reduce the torque loss caused by the wear. In addition, according to two states of the friction roller, it is possible to prevent multiple sheets from being fed simultaneously.

DETAILED DESCRIPTION OF THE INVENTION

A sheet separator for an automatic document feeder of the invention may be used in an image input/output apparatus such as a scanner, a multi-function peripheral, a copier, or a printer.

Figure 1:
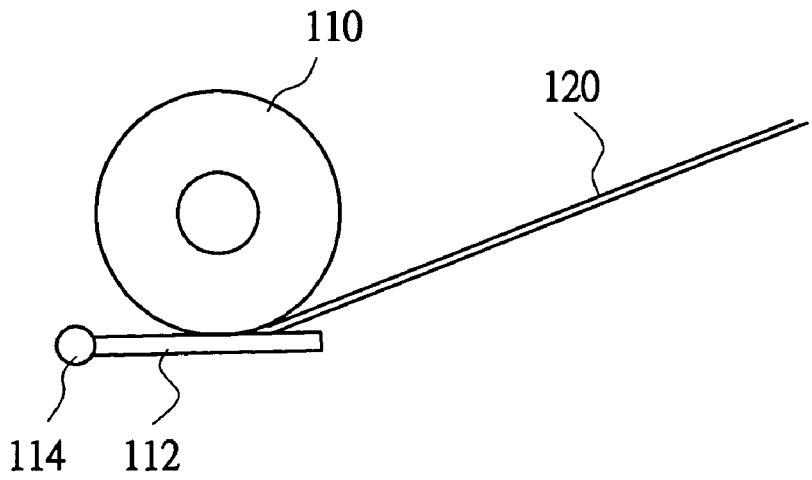
FIG. 1 (Prior Art)
FIG. 1 is a schematic side view showing a sheet separator for a conventional automatic document feeder.
Figure 2:
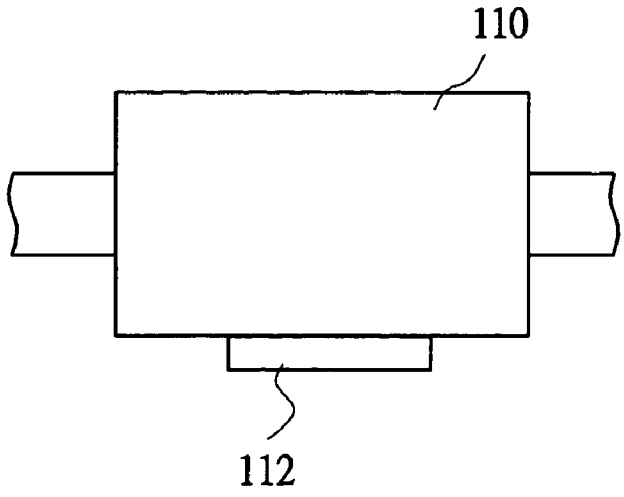
FIG. 2 (Prior Art)
FIG. 2 is a schematic front view showing the sheet separator for the automatic document feeder of FIG. 1.
Figure 3:
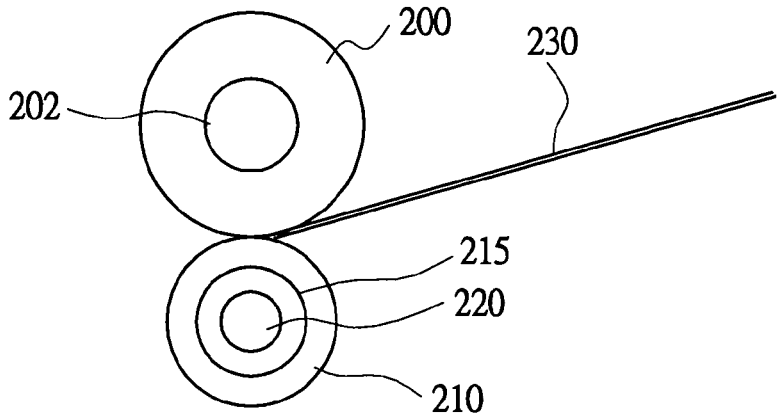
FIG. 3 (Prior Art)
FIG. 3 is a schematic side view showing a sheet separator for another conventional automatic document feeder.
Figure 4A:
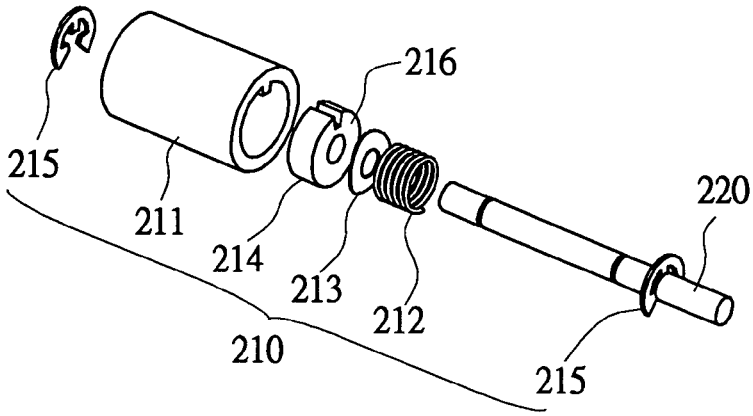
FIG. 4A (Prior Art)
FIG. 4A is a pictorial view showing the friction roller of FIG. 3.
Figure 4B:
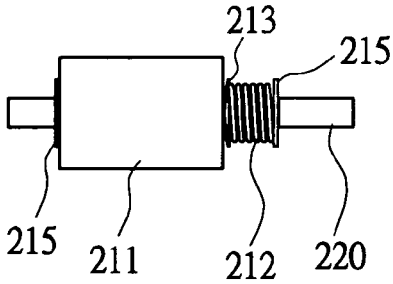
FIG. 4B (Prior Art)
FIG. 4B is a side view showing the friction roller of FIG. 3.
Figure 5:
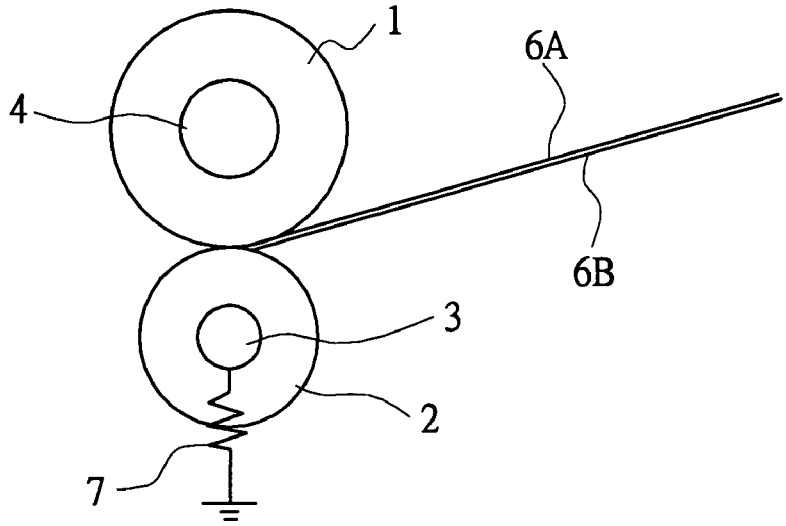
FIG. 5 is a schematic side view showing a sheet separator for an automatic document feeder according to a first embodiment of the invention.
Figure 6:
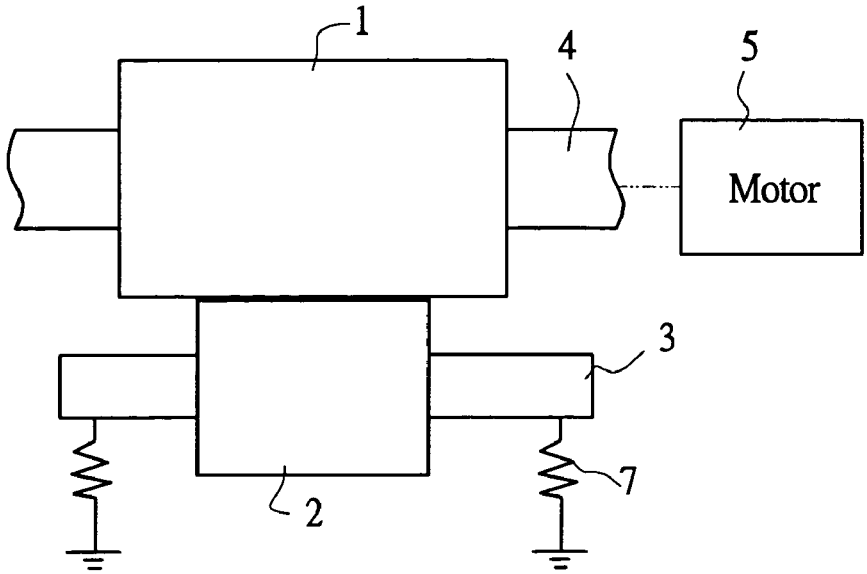
FIG. 6 is a schematic front view showing the sheet separator for the automatic document feeder of FIG. 5.

FIG. 5 is a schematic side view showing a sheet separator for an automatic document feeder according to a first embodiment of the invention. FIG. 6 is a schematic front view showing the sheet separator for the automatic document feeder of FIG. 5. Referring to FIGS. 5 and 6, the sheet separator for the automatic document feeder of this embodiment includes a separating roller 1, a friction roller 2, a first shaft 3, and a spring (also referred to as a force-applying mechanism) 7. The first shaft 3 is a stationary shaft. The separating roller 1 is fixed to a second shaft 4, which is directly or indirectly driven by a driving device such as a motor 5. The sheet separator of this embodiment may be used to separate and feed a plurality of sheets. For the sake of simplicity, instead of a stack of sheets, a first sheet 6A and a second sheet 6B are illustrated in this invention. In addition to feeding one sheet, the condition of feeding two sheets can surely occur at last no matter how many the sheets are.

The sheets 6A and 6B are located between the separating roller 1 and the friction roller 2. During the sheet-feeding operation, the friction roller 2 has three states including a first rotating state, a second rotating state, and a stationary state, which will be described hereinbelow with reference to FIGS. 7 and 8.

When the sheet 6A or 6B has not been fed through the path between the separating roller 1 and the friction roller 2, the friction roller 2 is in the first rotating state. The separating roller 1 in contact with the friction roller 2 drives the friction roller 2 to rotate. At this time, the friction between the separating roller 1 and the friction roller 2 is rolling friction, so no detrition is caused.

Figure 7:
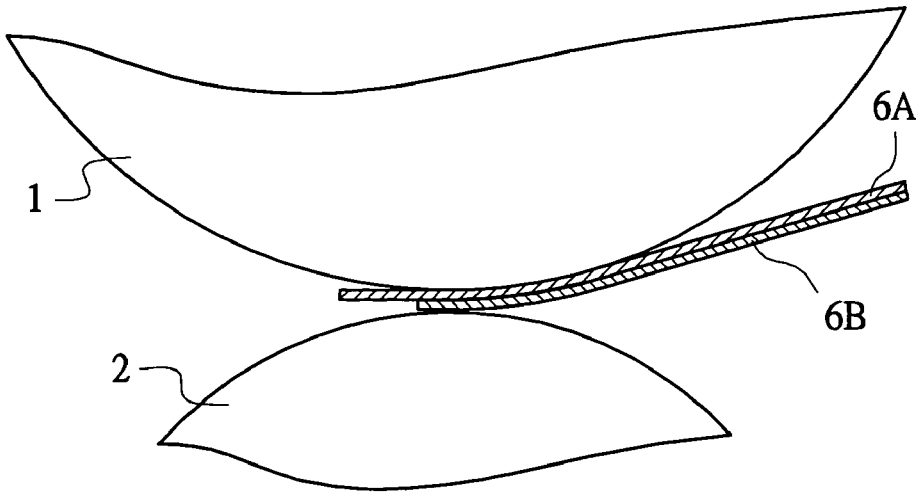
FIG. 7 is a partially enlarged view showing the sheet separator of FIG. 5, which is feeding and separating two sheets.

When the first sheet 6A is fed through the path between the separating roller 1 and the friction roller 2, the second sheet 6B is fed into the path between the first sheet 6A and the friction roller 2, as shown in FIG. 7. In the embodiment, the friction coefficient between the separating roller 1 and the first sheet 6A is greater than that between the first sheet 6A and the second sheet 6B, and the driving torque caused by the second sheet 6B against the friction roller 2 is smaller than the damping torque, which is caused by the first shaft 3 against the friction roller 2 in order to stop the rotation of the friction roller 2. Consequently, the separating roller 1 directly moves the first sheet 6A, and the second sheet 6B and the friction roller 2 are motionless to cause the first sheet 6A to slide relative to the second sheet 6B.

At this time, the friction between the separating roller 1 and the first sheet 6A is rolling friction, and the friction roller 2 and the second sheet 6B have no relative motion, so no detrition is caused.

The first shaft 3 may be always kept stationary, but it also may provide the damping torque for stopping the rotation of the friction roller 2 if it rotates. The damping torque may be caused by the friction force or magnetic drag force between the first shaft 3 and the friction roller 2. Therefore, in addition to controlling the friction coefficient between the first shaft 3 and the friction roller 2, the normal force between the first shaft 3 and the friction roller 2 also has to be well controlled.

In this embodiment, two springs 7 are adopted to push the first shaft 3 up so as to provide a normal force between the separating roller 1 and the sheet, the sheet and the friction roller 2, and the first shaft 3 and the friction roller 2.

In order to make the friction roller 2 rotate when it contacts the separating roller 1, the driving torque caused by the friction coefficient between the friction roller 2 and the separating roller 1 must be greater than the damping torque between the friction roller 2 and the first shaft 3.

Figure 8:
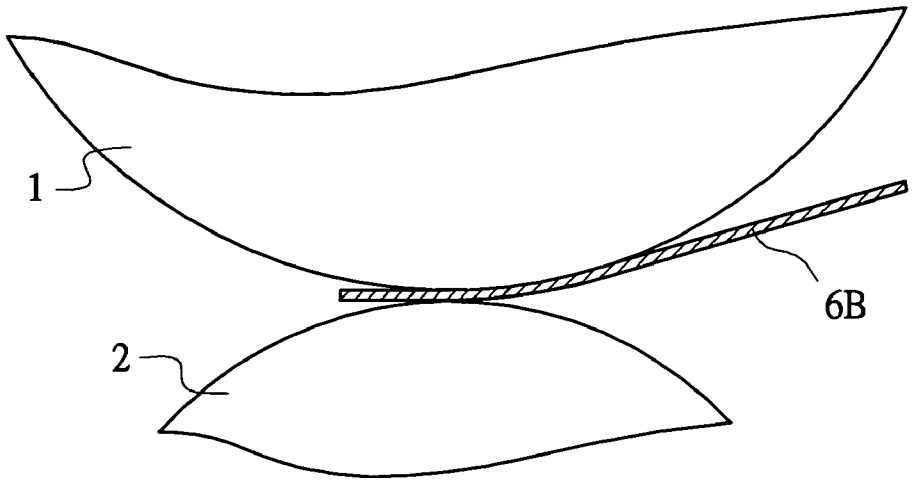
FIG. 8 is a partially enlarged view showing the sheet separator of FIG. 5, which is feeding one sheet.

After the first sheet 6A is fed, the separating roller 1 and the friction roller 2 directly feed the second sheet 6B, as shown in FIG. 8. At this time, the separating roller 1 utilizes the friction force between it and the second sheet 6B to move the second sheet 6B, and the second sheet 6B utilizes the friction force between it and the friction roller 2 to rotate the friction roller 2. The driving torque caused by the second sheet 6B against the friction roller 2 must be configured such that it is greater than the damping torque caused by the first shaft 3 against the friction roller 2. In this situation, there is no relative sliding motion between the separating roller 1 and the sheet, and there is also no relative slide motion between the friction roller 2 and the sheet. Thus, the detrition of the friction roller may be reduced.

Figure 9:
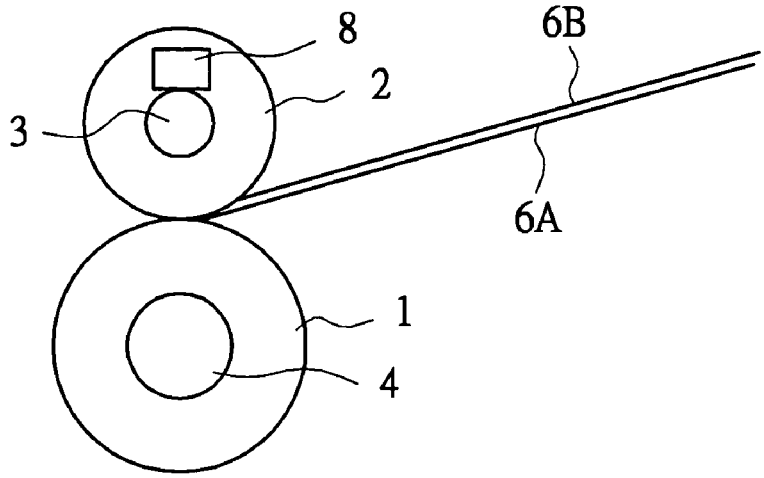
FIG. 9 is a schematic side view showing a sheet separator for an automatic document feeder according to a second embodiment of the invention.
Figure 10:
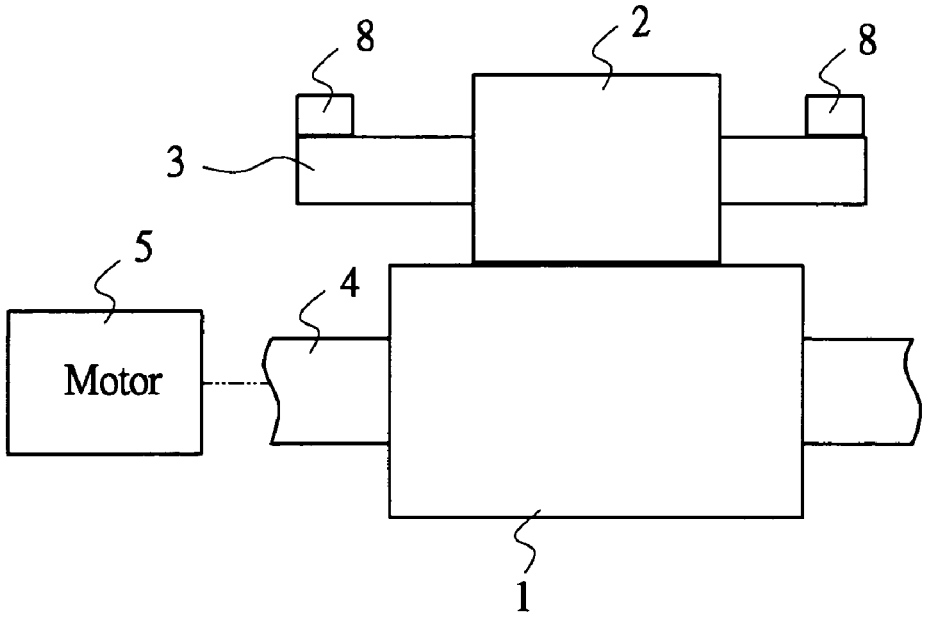
FIG. 10 is a schematic front view showing the sheet separator for the automatic document feeder of FIG. 9.

FIG. 9 is a schematic side view showing a sheet separator for an automatic document feeder according to a second embodiment of the invention. FIG. 10 is a schematic front view showing the sheet separator for the automatic document feeder of FIG. 9. As shown in FIGS. 9 and 10, the friction roller 2 of this embodiment is located above the separating roller 1, the bottommost sheet 6A is first separated and fed. The second embodiment is similar to the first embodiment except for some differences, which will be described hereinbelow. The first embodiment has a resilient mechanism that utilizes a resilient force to push the separating roller 1 against the friction roller 2, while the second embodiment has a gravity mechanism that utilizes the gravity to push the separating roller 1 against the friction roller 2. The gravity mechanism includes two counterbalances 8 fixed to the first shaft 3. In other embodiments, the number of counterbalance(s) 8 may be one, and the counterbalances 8 also may be fixed to the friction roller 2. Alternatively, the gravity mechanism also may be created using the gravity forces of the friction roller 2 and the first shaft 3.

Figure 11:
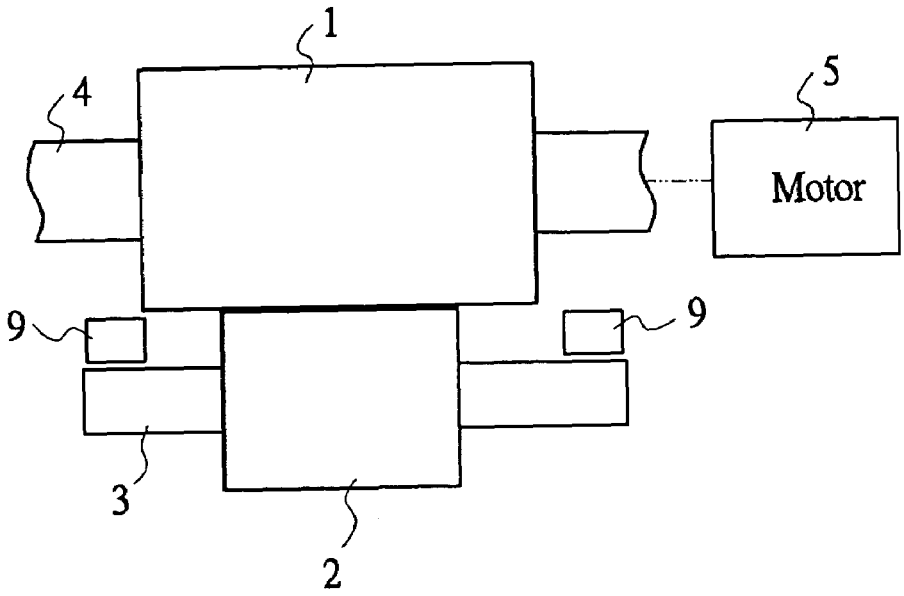
FIG. 11 is a schematic front view showing a sheet separator for an automatic document feeder according to a third embodiment of the invention.

FIG. 11 is a schematic front view showing a sheet separator for an automatic document feeder according to a third embodiment of the invention. This embodiment is similar to the first embodiment, but differs from the first embodiment in that this embodiment utilizes a magnetic force from a magnetic mechanism to push the separating roller 1 against the friction roller 2. The magnetic mechanism includes two magnets 9, and the first shaft 3 is made of a magnetic material and attracted by the magnets 9 to push the friction roller 2 toward the separating roller 1.

Figure 12:
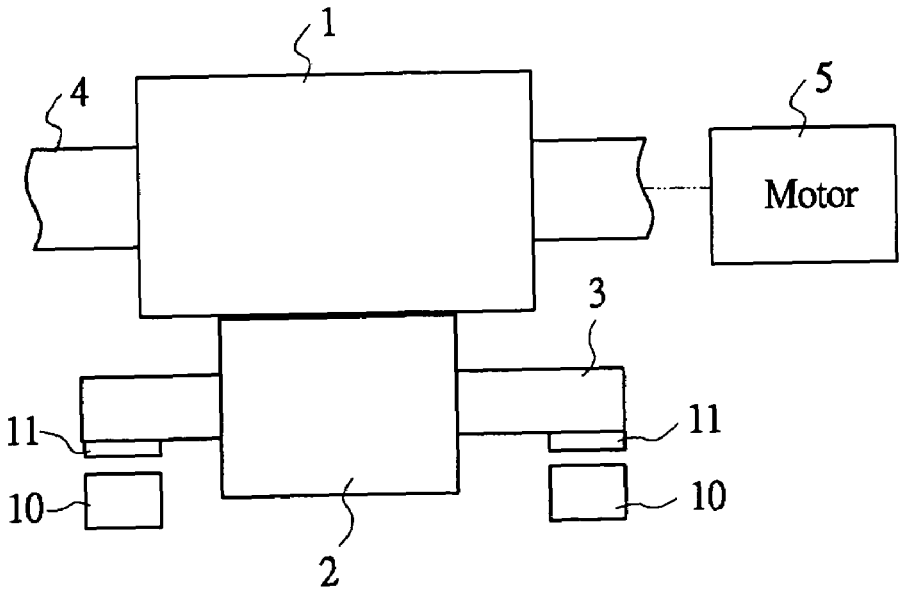
FIG. 12 is a schematic front view showing a sheet separator for an automatic document feeder according to a fourth embodiment of the invention.

FIG. 12 is a schematic front view showing a sheet separator for an automatic document feeder according to a fourth embodiment of the invention. This embodiment is similar to the third embodiment, but differs form the third embodiment in that a magnetic mechanism of this embodiment includes a stationary first magnet 10 and a second magnet 11 attached to the first shaft 3. The first magnet 10 repels the second magnet 11 to push the friction roller 2 toward the separating roller 1. One of ordinary skill in the art may easily understand that other configurations also may be used to make the first magnet 10 attract the second magnet 11 to push the friction roller 2 toward the separating roller 1.

Figure 13:
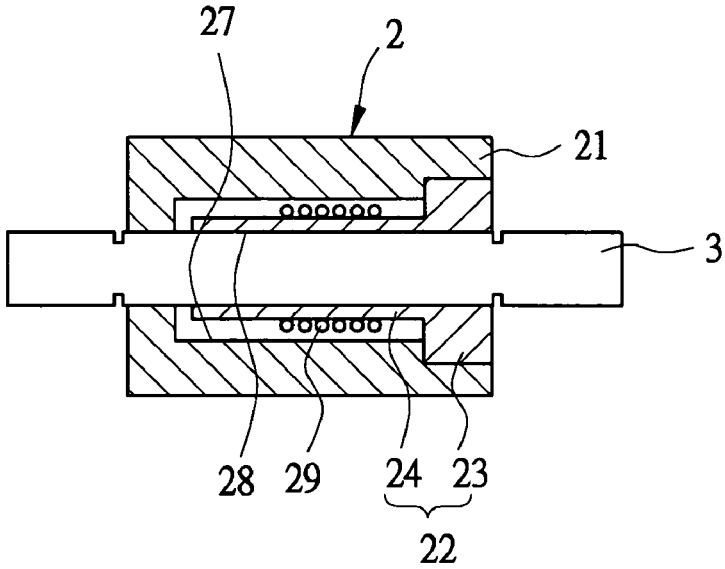
FIG. 13 is a cross-sectional view showing the friction roller of the invention.
Figure 14:
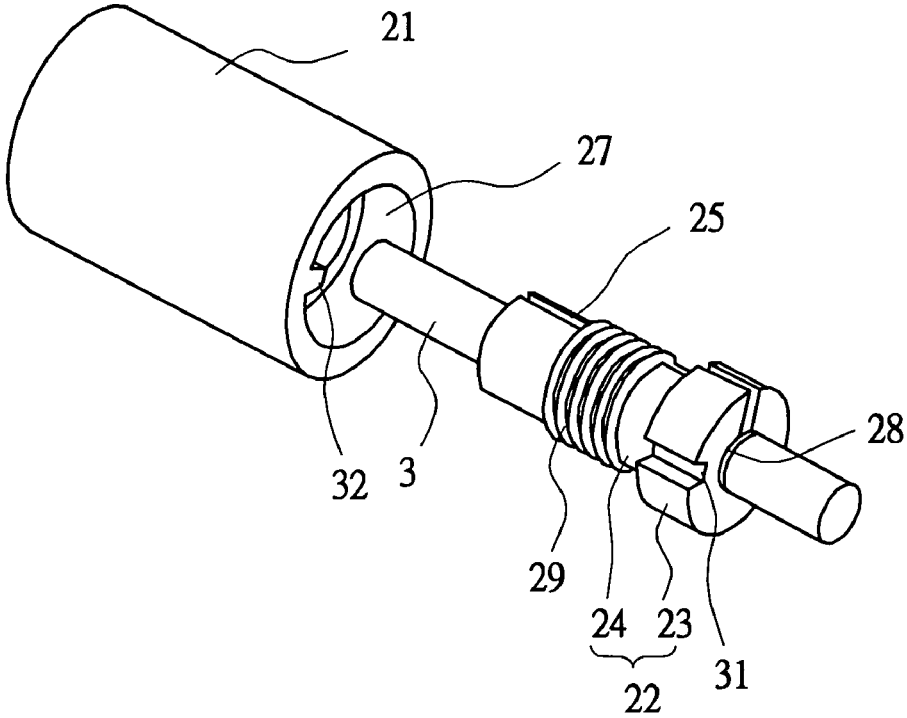
FIG. 14 is a 3-D exploded view showing the friction roller of the invention.

FIG. 13 is a cross-sectional view showing the friction roller of the invention. FIG. 14 is a 3-D exploded view showing the friction roller of the invention. As shown in FIGS. 13 and 14, the friction roller 2 includes an outer column 21 and an inner column 22. An outer surface of the outer column 21 is usually coated with a layer of rubber material. The outer column 21 is formed with a first hole 27 and in contact with the separating roller 1 in the first rotating state. The inner column 22 is formed with a second hole 28 to fit with the first shaft 3, and the inner column 22 is arranged within the first hole 27 of the outer column 21. That is, the inner column 22 is rotatably supported on the first shaft 3 and arranged within the outer column 21. The inner column 22 and the first hole 27 may have circular or rectangular cross sections as long as their cross sections may fit with each other. The inner column 22 includes a first column 23 and a second column 24. The second column 24 is connected to the first column 23, and the inner column 22 is fixed to the outer column 21 through the first column 23. For example, a keyway 32 of the outer column 21 may be fit with a slot 31 of the first column 23.

The inner column 22 is formed with an opening 25, which extends in an axial direction of the first shaft 3 and communicates with the second hole 28. In this embodiment, the opening 25 is lengthwise formed on a surface of the inner column 22. The friction roller 2 further includes a resilient member 29, which may be a helical spring or an elastic ring. The inner column 22 is fit with the resilient member 29 and is shrunk to contact the first shaft 3, thereby generating the damping torque. As shown in FIGS. 13 and 14, the resilient member 29 wraps around the inner column 22 and applies pressure on the inner column 22, such that the inner colunm 22 and the first shaft 3 act on each other to produce the damping torque.

In other embodiments, it is also possible to utilize an outward expanding force of the hollow first shaft 3 to generate the damping torque. In the embodiment, the hollow first shaft is formed with a slit, and the first shaft is compressed to reduce its outer diameter. Then, the first shaft is fit into the hole of the friction roller to provide the torque for the friction roller by the outward expanding force of the first shaft.

Figure 15:
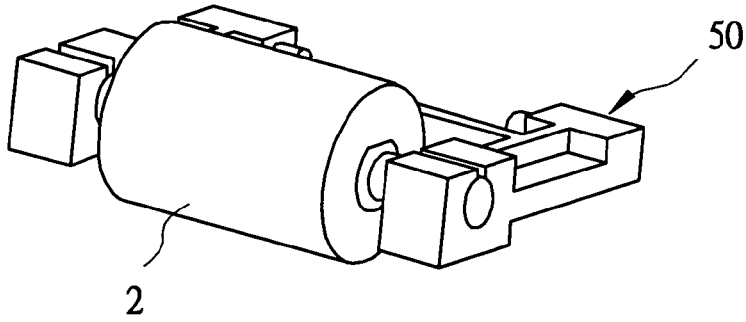
FIG. 15 is a pictorial view showing a friction roller and a brake mechanism according to a fifth embodiment of the invention.
Figure 16:
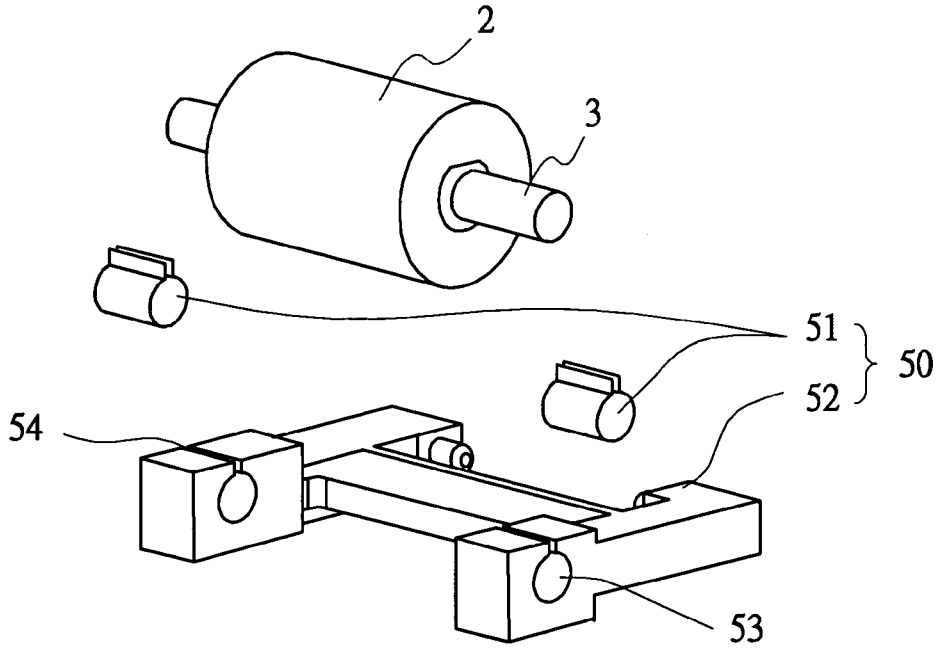
FIG. 16 is a 3-D exploded view of FIG. 15.

FIG. 15 is a pictorial view showing a friction roller and a brake mechanism according to a fifth embodiment of the invention. FIG. 16 is a 3-D exploded view of FIG. 15. Referring to FIGS. 15 and 16, the sheet separator in the embodiment further includes a brake mechanism 50. The brake mechanism 50 includes a support 52 and two elastic sleeves 51, and the support 52 is formed with two holes 53 and gaps 54 communicating with the holes 53. The elastic sleeves 51 provides the damping torque for the first shaft 3 fit therein so as to brake the friction roller 2 and implement the above-mentioned sheet-separation operation.

Consequently, the first shaft 3 of the invention is inserted into the friction roller 2 to provide a damping torque for stopping the rotation of the friction roller 2, wherein the first shaft 3 and the friction roller 2 are kept stationary or rotatable relative to each other.

According to the above-mentioned embodiment, the invention has the following advantages.

1. Since no relative sliding motion is caused between the separating roller 1 and the sheet and between the friction roller 2 and the sheet, the detrition of the separating roller 1 and the friction roller 2 may be reduced, the torque loss of the system may be reduced, and the scanning speed may be increased.

2. Using the friction roller 2 to stop the sheet may stabilize the sheet-separating operation.

3. Using the damping force caused between the friction roller 2 and the first shaft 3 to stop the rotation of the friction roller 2 may effectively reduce the design parameters and provide more stable operation conditions.

4. Using the damping force caused between the first shaft 3 and the support 52 to stop the rotation of the friction roller may reduce the dimension of the friction roller and save the arrangement space accordingly.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A sheet separator for an automatic document feeder for separating and feeding a first sheet and a second sheet adjacent to the first sheet sequentially, the sheet separator comprising:

a separating roller driven to rotate by a driving device;

a friction roller having a first rotating state, in which the friction roller is driven to rotate by the separating roller, a second rotating state, in which the friction roller is driven to rotate by the second sheet, and a stationary state, in which the friction roller is stationary, wherein in the stationary state of the friction roller, the separating roller directly feeds the first sheet, and the friction roller pushes the second sheet toward the first sheet so as to make the first sheet slide on the second sheet;

a first shaft inserting into the friction roller and providing a damping torque for stopping the rotation of the friction roller, and a force-applying mechanism for pushing the separating roller against the friction roller, wherein:

the friction roller is rotatably mounted to the first shaft, and the first shaft provides the damping torque for stopping the rotation of the friction roller according to a damping force between the first shaft and the friction roller; and the friction roller comprises:

an outer column being in contact with the separating roller in the first rotating state;

an inner column rotatably supported on the first shaft, the inner column being arranged within the outer column; and a resilient member wrapping around the inner column and applying pressure on the inner column, such that the inner column and the first shaft act on each other to produce the damping torque.

2. The sheet separator according to claim 1, wherein the force-applying mechanism is a resilient mechanism for pushing the separating roller and the friction roller against each other using a resilient force.

3. The sheet separator according to claim 2, wherein the resilient mechanism comprises a spring.

4. The sheet separator according to claim 1, wherein the force-applying mechanism is a gravity mechanism for pushing the separating roller and the friction roller against each other using a gravity force.

5. The sheet separator according to claim 4, wherein the gravity mechanism comprises a counterbalance fixed to the first shaft.

6. The sheet separator according to claim 4, wherein the gravity mechanism comprises a counterbalance fixed to the friction roller.

7. The sheet separator according to claim 1, wherein the force-applying mechanism is a magnetic mechanism for pushing the separating roller and the friction roller against each other using a magnetic force.

8. The sheet separator according to claim 7, wherein the magnetic mechanism comprises a magnet, and the first shaft is made of magnetic material and is attracted by the magnet to push the friction roller toward the separating roller.

9. The sheet separator according to claim 7, wherein the magnetic mechanism comprises a fixed first magnet and a second magnet attached to the first shaft, and the first magnet attracts the second magnet to push the friction roller toward the separating roller.

10. The sheet separator for the automatic document feeder according to claim 7, wherein the magnetic mechanism comprises a fixed first magnet and a second magnet attached to the first shaft, and the first magnet repels the second magnet to push the friction roller toward the separating roller.

11. The sheet separator according to claim 1, wherein the inner column comprises:

a first column; and a second column connected to the first column, the inner column being fixed to the outer column through the first column.

12. The sheet separator according to claim 1, wherein an opening is lengthwise formed on a surface of the inner column.

13. The sheet separator according to claim 1, wherein the resilient member is a helical spring.

14. The sheet separator according to claim 1, wherein the resilient member is an elastic ring.

15. The sheet separator according to claim 1, wherein the damping force is a friction force.

16. A sheet separator for an automatic document feeder for separating and feeding a first sheet and a second sheet adjacent to the first sheet sequentially, the sheet separator comprising:

a separating roller driven to rotate by a driving device;

a friction roller having a first rotating state, in which the friction roller is driven to rotate by the separating roller, a second rotating state, in which the friction roller is driven to rotate by the second sheet, and a stationary state, in which the friction roller is stationary, wherein in the stationary state of the friction roller, the separating roller directly feeds the first sheet, and the friction roller pushes the second sheet toward the first sheet so as to make the first sheet slide on the second sheet;

a first shaft inserted into the friction roller to provide a damping torque for stopping the rotation of the friction roller, and a force-applying mechanism for pushing the separating roller against the friction roller, wherein the damping torque is caused by a magnetic drag force.

* * * * *